US007222462B2

(12) United States Patent
Ellingson

(10) Patent No.: US 7,222,462 B2
(45) Date of Patent: May 29, 2007

(54) SILL PAN SYSTEM

(75) Inventor: Robert T. Ellingson, Social Circle, GA (US)

(73) Assignee: Astro Plastics, Inc., Covington, GA (US)

( * ) Notice: Subject to any disclaimer, the term of this patent is extended or adjusted under 35 U.S.C. 154(b) by 494 days.

(21) Appl. No.: 10/740,179

(22) Filed: Dec. 17, 2003

(65) Prior Publication Data

US 2005/0144865 A1 Jul. 7, 2005

(51) Int. Cl.
*E06D 13/14* (2006.01)

(52) U.S. Cl. ..... 52/62; 52/204.54

(58) Field of Classification Search ..... 52/211, 52/212, 204.53, 204.54, 60, 741.4, 745.15, 52/745.16, 58, 62, 213, 204.5; 49/467
See application file for complete search history.

(56) References Cited

U.S. PATENT DOCUMENTS 3,838,544 A * 10/1974 Hindall ..... 52/60
4,755,339 A 7/1988 Reilly et al.
4,761,916 A 8/1988 Sanok et al.
4,826,417 A 5/1989 Reilly et al.
5,377,464 A 1/1995 Mott et al.
5,542,217 A 8/1996 Larivee, Jr.
5,586,415 A 12/1996 Fisher et al.
6,098,343 A 8/2000 Brown et al.
6,119,416 A 9/2000 Larson
6,182,405 B1 2/2001 Lindahl
6,212,834 B1 4/2001 Lindgren
6,244,001 B1 6/2001 Anastasi
6,305,130 B1 10/2001 Ackerman, Jr.
6,401,401 B1 * 6/2002 Williams ..... 52/58
6,401,402 B1 * 6/2002 Williams ..... 52/58
6,401,601 B1 * 6/2002 Wu ..... 99/331
6,401,602 B1 * 6/2002 Lin ..... 99/339
6,526,709 B1 3/2003 Jacobsen
2001/0034984 A1 * 11/2001 Murphy et al. ..... 52/204.5

OTHER PUBLICATIONS

Jamsill, Inc., Door & Window Sill Pan Flashing, http://www.jamsill.com/faqs.asp.
Jamsill Guard Brochure.
Dinesol Building Products Ltd., Door Sill Pan Brochure.

* cited by examiner

*Primary Examiner*—Naoko Slack
*Assistant Examiner*—William Gilbert
(74) *Attorney, Agent, or Firm*—Womble Carlyle Sandridge & Rice

(57) ABSTRACT

A sill pan system is provided for installation along the bottom plate of a framed-in window or door opening to prevent water leakage. The system includes end pieces that are fitted in the bottom corners of the opening and a central web that spans, partially overlaps, and is adhered to the end pieces. The central web is formed of a transparent or translucent plastic to allow visual confirmation that a good seal is formed between the overlapping portions of the web and end pieces. The web is formed with inside flanges and flashing strips that are connected with flexible hinges so that web material can be rolled into a roll. The components may be formed with an abrasion resistant upper surface cladding and the central web may be formed with longitudinally extending drain channels for directing water to the ends of the pan for drainage.

22 Claims, 3 Drawing Sheets

SILL PAN SYSTEM

TECHNICAL FIELD

This invention relates generally to window and door installations and more particularly to sill pans installable beneath window and door units to prevent water migration into underlying framing and sub-flooring.

BACKGROUND

In modern construction, window and door systems generally are provided as integral pre-hung units that include door or window panels pre-mounted in a frame. The frame typically is formed by vertical jambs, a top header, and a bottom sill or threshold assembly that spans the bottom ends of the jambs. These pre-hung units are fitted and secured within appropriately sized framed-in openings in the walls of a building. In the case of windows, the openings generally are framed by a horizontal bottom sill plate, vertical studs, and a header. Framed-in openings for pre-hung door units also include vertical studs and a header, but the bottom sill plate of the door opening usually is formed by the sub-floor of the building. In either event, the pre-hung unit is positioned with its sill or threshold resting on the bottom sill plate of the framed-in opening, whereupon the unit is leveled, plumed, and secured within the opening with nails or screws.

An age-old problem with window and door units is the tendency, over time, for rain water to leak beneath the sill or threshold of the unit. Such leakage often occurs at the lower corners of the unit where the jambs meet the sill, but also can occur in mid-portions of the unit as a result of cracking or separation of sill components. Eventually, this leakage causes the underlying framing studs and sub-floor components to rot. Since this rot generally is hidden from view, it often is not discovered until it is so severe that major renovation to replace rotted members is required.

To address the problem of rain water leakage around windows and doors, building products suppliers have developed water-proof sill pans. These sill pans generally are designed to be installed in a framed-in window or door opening extending along and covering the bottom sill plate of the opening. Most prior art sill pans are made of plastic and include a central web that rests on and spans the plate, upwardly projecting end walls that extend partially up the vertical studs of a framed-in opening, an up-turned flange extending along the inside edge of the web, and flashing strips that wrap around onto the outside of the framed-in opening. In some cases, flashing pans are integrally molded from a single piece of plastic. In others, end pieces of molded plastic are installed in the bottom corners of a framed-in opening and a separate elongated central web is installed along the bottom plate with its ends partially overlapping the end pieces. The overlapping ends of the web are then secured to the end pieces with, for example, PVC cement or other adhesive. In any event, the purpose of a sill pan is to intercept rain water that may leak beneath a window or door unit and to prevent that water from soaking into wooden framing members and sub-floor components, thereby to prevent the rotting of these structures. Examples of prior art sill pans can be found in U.S. patents including U.S. Pat. No. 6,098,343 of Brown, and U.S. Pat. No. 6,401,402 of Williams. Prior art sill pans of the types discussed above are available from a number of building products suppliers, including Dinesol Building Products Ltd. of Youngstown, Ohio and Jambsil, Inc. of Talent, Oreg.

While prior art sill pans have been somewhat successful, they nevertheless have been plagued with a variety of problems and shortcomings inherent in their respective designs. Single piece molded sill pans, for instance, rarely fit precisely between the vertical jambs of a framed-in opening. This results in gaps between the ends of the sill pan and the jambs or in creases in the plastic of the pan, which can allow rainwater to seep beneath the sill pan and into the framing members below. Multiple piece sill pans result in a good fit between the jambs, but suffer from poor adhesive coverage and thus poor seals between the ends of the center web and the end pieces, which they overlap. Poor seals can result, in part, from the requirement in some systems that the overlapping portions be held together for 5 or more minutes as the adhesive sets. Installers are unlikely to follow these instructions, resulting in poor and leaky adhesive joints and thus poor seals. These poor seals allow water to seep through the adhesive joints and into the framing members below. Further, in both of these sill pan designs, water that is intercepted by the sill pan can collect between the sill pan and the wooden sill of windows, which can result in rotting of the window sill itself.

Another problem with prior art sill pans, especially when installed beneath door units, is that the constant jostling of the threshold of the door unit as it is repeatedly stepped on during use can wear through the material of the pan at locations where the door unit rests on the pan. This is particularly true for metal door units. At least one manufacturer has attempted to address this problem by providing an aluminum cladding bonded to the surfaces of the sill pan in areas of door unit contact. This solution, however, is expensive, not always successful, and can result in an unpleasant clicking sound when stepping upon the threshold.

A continuing need exists for an improved sill pan system that successfully addresses the above and other problems and shortcomings of existing prior art seal pans. It is to the provision of such a sill pan system that the present invention is primarily directed.

SUMMARY OF THE INVENTION

Briefly described, the present invention comprises a sill pan system that successfully addresses the problems and shortcomings of the prior art. In one embodiment, the system comprises molded plastic end pieces that are fitted in the bottom corners of a framed-in door or window opening. The end pieces are formed with a flat panel, upstanding end walls that extend partially up the vertical studs of the opening, an upturned inside flange, and flashing that overlaps the outside of the framing members in the corners of the opening. A central web is configured to be installed between a pair of pre-fitted end pieces with the ends of the central web partially overlapping the end pieces. The central web has an upturned inside flange sized to match and form extensions of the inside flanges of the end pieces. The central web also has a downturned flashing strip along its outside edge, which is sized to match and form extensions of the flashing of the end pieces. Thus, when the central web and end pieces are in place in a framed-in opening, they form a sill pan that spans and covers the bottom sill plate of the opening in a somewhat traditional way.

In one embodiment of the sill pan system of this invention, the overlapping ends of the central web are bonded to the end pieces with an adhesive sealant such as, for instance, an adhesive caulk. According to one aspect of the invention, the central web of the sill pan system is made of a clear, translucent, or otherwise non-opaque extruded plastic material, at least in regions of overlap with the end pieces. Thus, when the overlapping ends of the central web are pressed onto the end pieces with adhesive sealant sandwiched therebetween, the spreading pool of sealant is clearly visible to the installer through the translucent material of the web. It has been found that any breaks, discontinuities, or regions of poor coverage in the pool of adhesive sealant become starkly apparent as the pool is viewed through the ends of the central web. Thus, a quick visible inspection by the installer after installation of the central web is all that is required to confirm that a complete water-tight seal has been formed between the end pieces and the overlapping ends of the central web. Alternatively, if a poor seal is indicated upon such visible inspection, the installer knows that leaks may occur and can repair the seal or simply remove the pan and replace it with a fresh pan with a visually confirmed seal.

In another aspect of the invention, the end pieces and central web of the pan system may be formed with a multi-ply plastic construction, especially for doorway installations. The upper surfaces of these components may be a cladding of hard abrasion resistant plastic such as, for example, polyurethane or nylon, and with the underlying substrate being made of a far less expensive plastic such as PVC. It has been found that sill pan components with such abrasion resistant upper surfaces can be even more resistant to being worn through by door units resting thereon than prior art aluminum clad sill pans. Further, the co-extrusion or co-molding of multi-ply plastic components is far less expensive and troublesome that fabricating plastic components with metal clad surfaces, as has been attempted in the prior art. The result is a superior abrasion resistant sill pan and lower manufacturing costs.

In yet another aspect of the invention, the upturned inside flange of the central web is formed to define a slot that receives and holds securely the upturned flanges on the end pieces when the ends of the web are overlapped and pressed onto the end pieces. In this way, the overlapping ends of the web are held automatically to the end pieces, eliminating the requirement that the components be held together for long periods of time while the adhesive sets. An installer need only press the ends of the web onto the end pieces, where they are held in place by the slots.

A further aspect of the invention includes longitudinal drainage channels formed along the length of the central web. These channels may be formed, for example, by short upstanding ribs or by longitudinal deformations in the web. In either event, water that may collect between the pan and overlying sill is directed along the channels to the ends of the drain pan, where it is more free to drain away.

In another aspect of the sill pan system of this invention, the central web is extruded as a very long single piece. The upstanding flange along the inside edge of the web and the flashing strip along its outside edge are connected to the central portion of the web by flexible hinge joints. These hinge joints may be a co-extrusion of a flexible plastic material or may be formed by extruded score lines in the web. With such a construction, it has been found that the long single piece of web material can be rolled up into a roll with the flange and flashing strip co-extensive with the central portion of the web. For installation of a sill pan, a length of web material is extracted from the roll and cut to the precise length needed to span and partially overlap the end pieces. The inside flange and flashing strip are then simply bent respectively up and down and the central web is installed as described above. With this unique construction, multiple sill pan installations can be shipped to installers in the form of several end pieces and a roll of web material, which is more efficient, less expensive, and produces less waste than traditional sill pan systems.

Thus, a unique sill pan system is now provided that successfully addresses the problems of prior art sill pans and their installation and that offers new advantages heretofore not available at all. These and other features, objects, and advantages of this invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
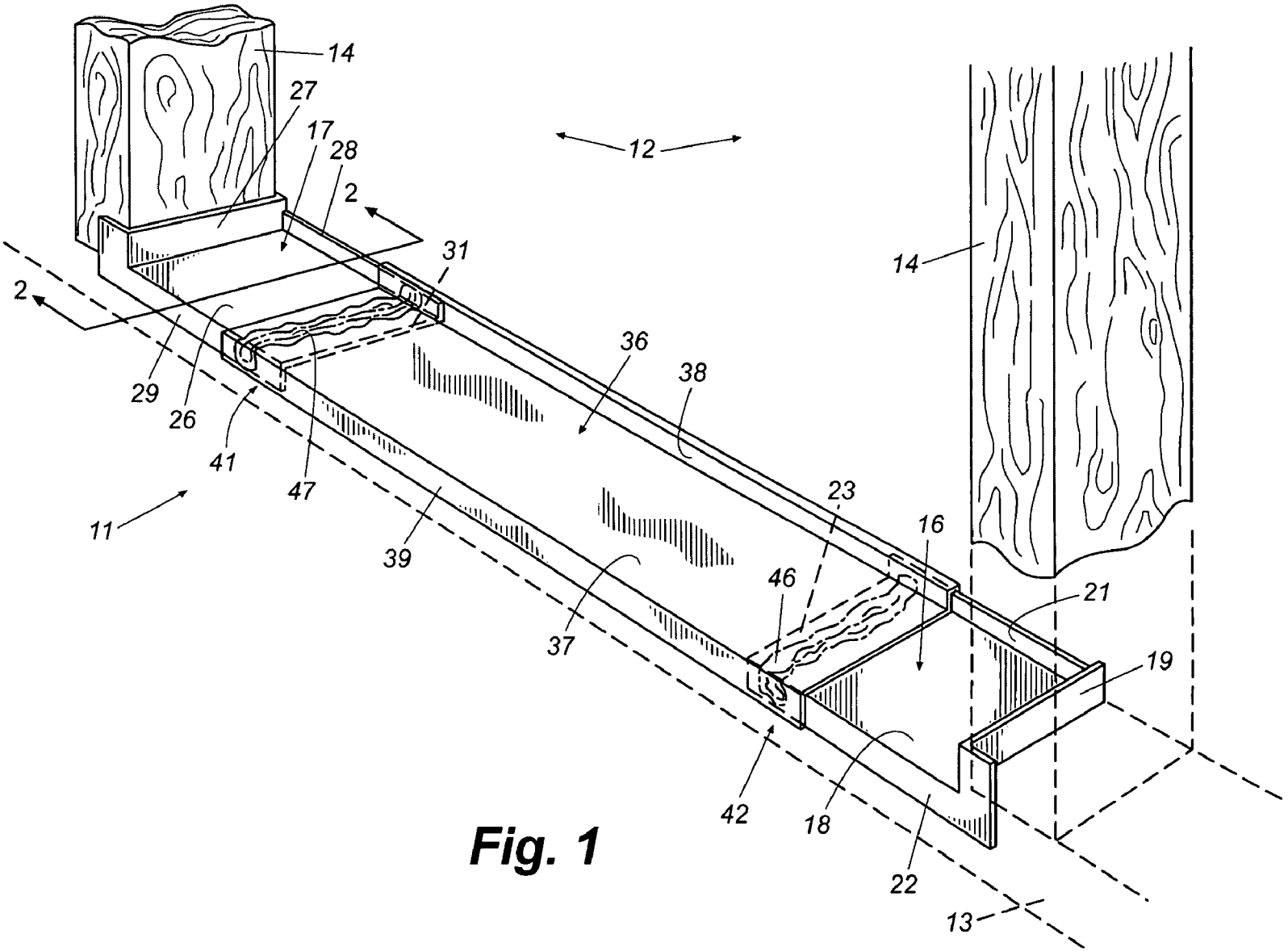
FIG. 1 is a perspective view of a sill pan system that embodies principles of the present invention and shown installed in a framed-in opening for a window or door.

Referring now in more detail to the drawing figures, wherein like numerals refer, where appropriate, to like part throughout the several views, FIG. 1 illustrates a sill pan system that embodies principles of the invention in a preferred form. The sill pan system 11 is shown installed in a framed-in opening 12 of a building structure. The framed-in opening 12 may be a window opening or a door opening and, in the illustrated embodiment, is defined by a sill plate 13 and a spaced pair of vertical studs 14. A horizontal header (not shown) defines the upper perimeter of the framed-in opening. If the framed-in opening is a window opening, the sill plate 13 may be defined by a horizontally extending stud. Alternatively, if the framed-in opening is a door opening, the sill plate generally will simply be part of the subfloor of the building structure. In either case, the sill pan system 11 of this invention is installed in the framed-in opening between the bottom end portions of the vertical studs 14 spanning and covering the sill plate 13.

The sill pan system 11 includes a right end piece 16 fitted in the bottom right corner of the framed-in opening and a left end piece 17, which is a mirror image of the right end piece, fitted in the bottom left corner of the framed-in opening. Preferably, each of the end pieces unitarily is fabricated of molded plastic material, as described in more detail below, and is impervious to water. The right end piece 16 is configured with a top panel 18, which overlies and covers a relatively short section of the sill plate 13, and a vertical end wall 19, which extends partially up the inside face of the vertical stud 14. An inside flange 21 projects upwardly along the inside edge of the panel 18 and flashing 22 overlaps the outside surfaces of the vertical stud 14 and the sill plate 13. The right end piece 16 terminates in a free end portion 23 spaced a relatively short distance from the vertical stud 14. It will thus be appreciated that the right end piece covers and protects the right end of the sill plate 13 and the bottom right corner portion of the framed-in opening 12.

Similarly, the bottom left corner of the framed-in opening is covered and protected by the left end piece 17, which, like the right end piece, has a top panel 26, a vertical end wall 27, an upwardly projecting inside flange 28, flashing 29, and a free end portion 31. Like the right end piece, the left end piece 17 covers and protects the left end of the sill plate 13 and the bottom left corner portion of the framed-in opening.

An elongated central web 36, which preferably is fabricated of extruded plastic material, is fitted on the sill plate 13 extending between the right and left end pieces 16 and 17. The length of the central web 36 is selected so that the ends of the central web overlap the free end portions 23 and 31 of the right and left end pieces respectively. The central web 36 is formed with a panel 37, an upstanding interior flange 38 extending along the inside edge of the panel 37, and a downturned flashing strip 39 extending along the outside edge of the panel. It will be seen from FIG. 1 that the inside flange 38 and flashing strip 39 are sized to match the flanges and flashing of the end pieces 16 and 17. In this way, when the central web 36 is in place spanning and partially overlapping the end pieces, a continuous sill pan is formed that spans and covers the sill plate 13 and the bottom corner portions of the framed-in opening 12. An adhesive sealant 46 and 47 bonds the overlapping portions of the central web and end pieces together to form a unitary sill pan structure and also seals against migration of water between the overlapping portions.

According to one important aspect of the present invention, the central web 36 is made of extruded plastic material such as, for instance, PVC. Further, the plastic material of the central web is formulated to be transparent, translucent, or otherwise non-opaque. This provides a unique advantage over prior art sill pan systems. Specifically, since the central web is non-opaque, the adhesive sealant 46 and 47 is visible to an installer through the central web as the central web is installed in the opening. As the ends of the central web are pressed down onto the overlapped free ends 23 and 31 of the end pieces with adhesive sealant between them, the spreading pool of sealant can be observed through the central web. If a void develops or is present in the pool of sealant during this process, the void is clearly visible to the installer and the installer is instantly aware that the void could result in water leakage. The installer can then take remedial action, such as applying additional sealant or simply removing the sill pan and installing a new pan. More typically, the installer will observe that the pool of sealant is smooth, continuous, and voidless, which confirms that a good seal has been formed and that water leakage between the overlapping portions of the central web and end pieces will not occur.

Figure 2:
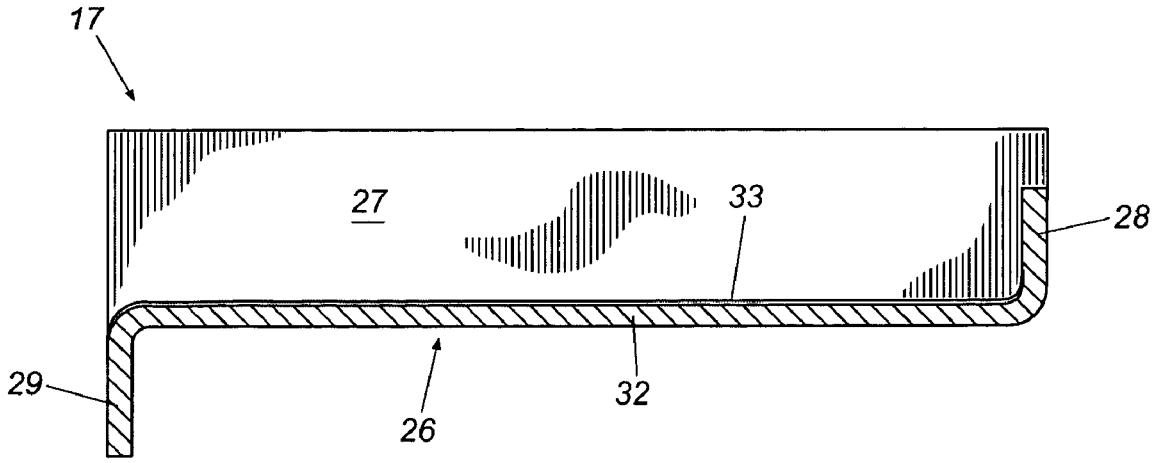
FIG. 2 is a cross-sectional view of an end piece of the sill pan system taken along 2—2 of FIG. 1.

FIG. 2 is a cross section along 2—2 of FIG. 1 and illustrates another aspect of the present invention. It should be understood that the thickness of the plastic material in FIG. 2, and also in the remaining figures, is exaggerated for clarity of description. FIG. 2 illustrates the left end piece 17 having top panel 26, end vertical end wall 27, inside flange 28, and flashing 29. The cross sectioned portions of the end piece 17 reveal that the end piece is molded or otherwise formed with a base material 32, which may be an inexpensive PVC plastic or other material, and an abrasion resistant cladding 33, which covers the exposed upper surfaces of the end piece. Preferably, the cladding is co-molded at the same time the end piece is formed so that it is integrally bonded to the base material and so that the fabrication process is efficient. Further, the cladding may cover all or only a portion of the exposed surface depending upon application specific requirements. The material from which the cladding is formed is selected for its high abrasion resistant properties. Suitable materials may include, for example, UHMWPE (Ultra High Molecular Weight Polyethylene), Nylon 6-6, Polyurethane, PTFE (Polytetrafluoroethylene), Polycarbonate, Acetal, Polypropylene, or any other suitably abrasion resistant material.

The abrasion resistant cladding provides a durable surface upon which portions of a door or window unit may rest. This aspect of the invention is particularly suitable for use beneath door units, which tend to move slightly and grind around on the sill pan as the threshold is stepped upon during use. Such action can, over time, wear through a sill pan made only of softer base material such as PVC, resulting in water leakage to the subfloor. However, the abrasion resistant cladding of the present invention provides a surface that is as highly resistant to wear, and, in fact, even more resistant than sill pans with metal clad exposed surfaces, which have been offered in the past. Advantageously, the process of forming sill pan components in a single co-molding or co-extrusion process is far less expensive and time consuming that the fabrication techniques required to provide metal clad sill pan components.

FIG. 2 illustrates an abrasion resistant surface on an end piece 17 of the sill pan system 11. It will be understood, however, that such a cladding can be provided on the exposed surface of the central web 36 as well through well-known and efficient co-extrusion techniques. Further, the cladding can be provided on all of the exposed surfaces or, if desired, only on those exposed surfaces that are subject to being worn through by abrasion.

Figure 3:
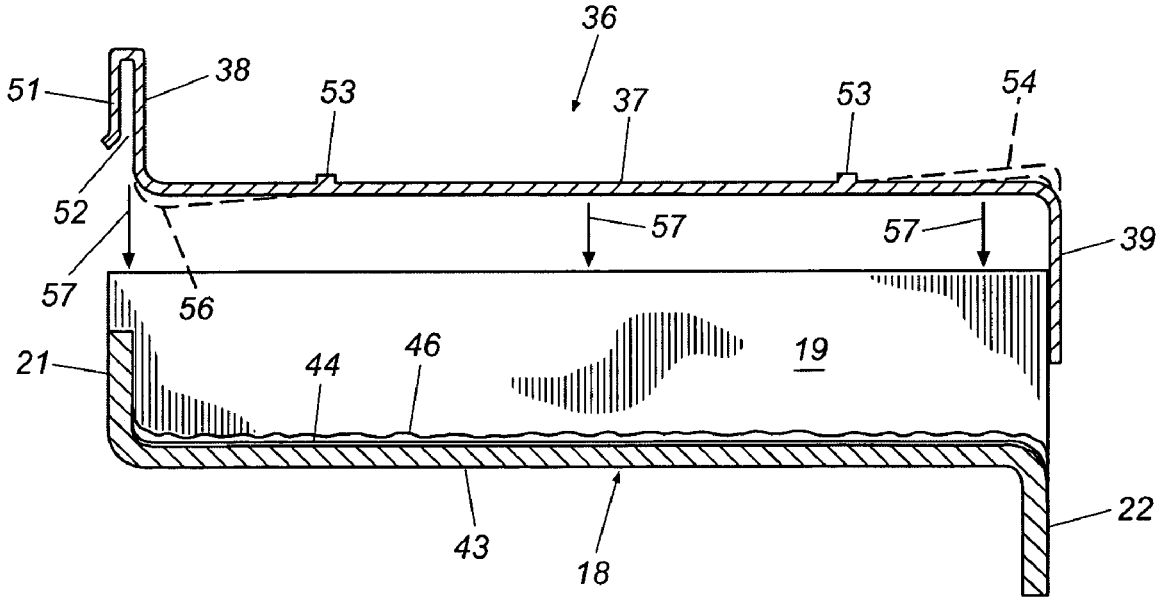
FIG. 3 is a partially cross-sectional view illustrating installation of the central web of the sill pan system on an end piece and showing the inside flange slot and longitudinal drain channels in the central web.

FIG. 3 illustrates yet additional aspects of the sill pan system of this invention. The view of FIG. 3 is a cross section taken from the center of a central web embodying principles of the invention, looking toward a right end piece, and shows the central web moving down into position as it would during installation. As previously described, the end piece has a top panel 18 formed with a plastic substrate that is clad with an abrasion resistant exposed surface 44. The end piece is formed with upstanding end wall 19, inside flange 21, and flashing 22. An adhesive sealant 46 is shown applied to the free end portion of the end wall, where an end of the central web 36 will overlap, to bond and seal the free end of the end piece to the overlapping end of the central web.

The central web 36, which preferably is formed of extruded plastic, has an elongated top panel 37, an inside flange 38 extending along the inside edge of the panel, and a flashing strip 39 extending along the outside edge of the panel. The central web may or may not be formed with an abrasion resistant cladding as desired. The inside flange 38 in this embodiment is formed with an additional feature according to the invention. Specifically, a downturned leg 51 is formed with and spaced from the inside flange 38 to define a downwardly facing slot 52. The slot 52 is sized and configured to receive and capture a length of the inside flange 21 of the end piece when the central web is moved down into position as indicated by arrows 57. In this way, when an installer presses the ends of the central web down into the pool of adhesive sealant 46, the inside flange 21 of the end piece is securely captured and held in the slot 51 until the adhesive cures. This eliminates the requirement of prior art systems that the overlapping ends be held manually together by an installer for several minutes until the adhesive sealant cures, which installers, in reality, are not apt to do.

The central web 36 in FIG. 3 is further provided with features to eliminate standing water on its top panel 37, which, as mentioned above, can deteriorate a window sill resting on the sill pan. One unique way of accomplishing this is to extrude the central web with one or more longitudinally extending, upwardly projecting ribs 53 along its length. The ribs 53 define between them a longitudinal channel, which tends to direct water that may seep beneath a sill to the ends of the sill pan, where it can more easily drain away from the structure. As an alternative to upstanding ribs, the central web may be formed with a top panel that is slightly deformed in cross section to define a channel. For example, the outside edge portion of the central panel may be formed with a slight upwardly extending lip, as indicated by phantom lines 54 in FIG. 3. A longitudinal channel is thus formed between the lip 54 and the inside flange 38 to direct water to the ends of the sill pan. The top panel 37 may be further or alternatively formed with a slight downturned trough along its length, as indicated by phantom lines 56. The trough 56, either alone or in combination with lip 54, also forms a longitudinal channel that helps direct water to the ends of the sill pan for drainage. While lip 54 and trough 56 are illustrated in FIG. 3 as forming drain channels, the invention contemplates any type of feature or deformity in the top panel 37 of the central web 36 that functions to channel water toward the end pieces of the pan for drainage.

Figure 4:
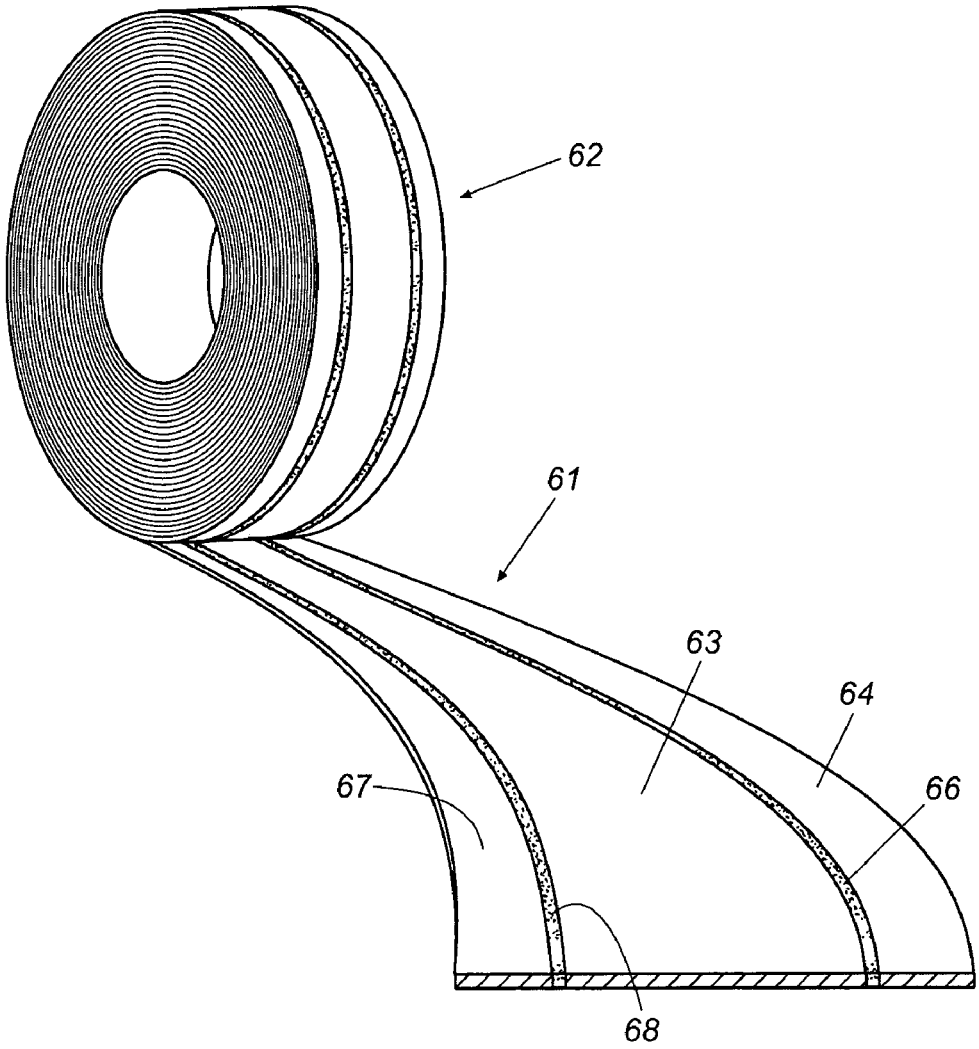
FIG. 4 is a perspective view of a very long length of central web material rolled into a roll from which central web sections can be cut according to the invention.
Figure 5:
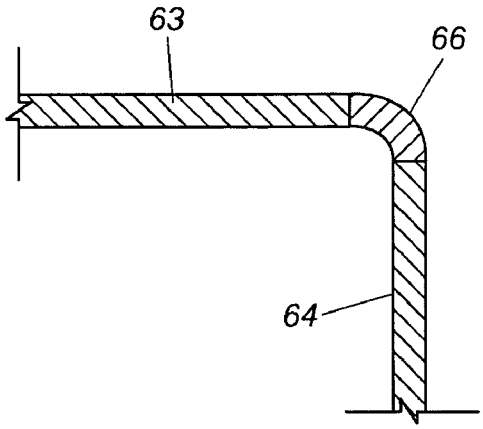
FIG. 5 is a cross-sectional view of the outside edge portion of a rollable central web illustrating one method of attaching the flashing strip and inside flange to the web with a flexible hinge.
Figure 6:
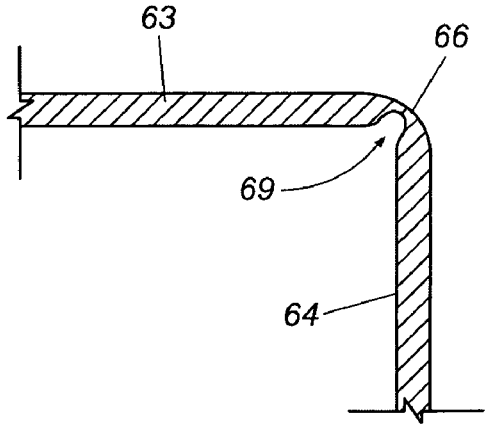
FIG. 6 is a cross-sectional view of the outside edge portion of a rollable central web illustrating and alternate method of attaching the flashing strip and inside flange to the web with a flexible hinge.

FIGS. 4 through 6 illustrate yet another novel aspect of the sill pan system of this invention in the form of rollable central web stock. As mentioned above, prior art sill pan systems typically have been shipped to installers with end pieces and separate lengths of central web sized to fit in a particular size framed-in opening. In some cases, central webs are pre-cut to fit standard size openings. In others, long pieces of central web are provided and can be cut off by an installer. In the first instance, packing and shipping is inefficient, particularly when shipping multiple sill pan systems, due to the lengths and unusual configurations of the central web. In the latter case, shipping is also inefficient, and, in addition, the requirement that over-long central webs be cut to size results in installer errors and waste.

In the embodiment illustrated in FIGS. 4 through 6, a substantially continuous length of central web stock 61 is extruded in such a way that it is rollable into a roll 62 for shipment. More specifically, the central web stock 61 is extruded so that the flashing strip 64 and inside flange 67 are attached to the top panel 63 by means of flexible hinges 66 and 68 respectively. As illustrated in FIG. 4, this allows the flashing strip 64 and inside flange 67 to fold down to a position co-extensive with the top panel 63. In this configuration, the central web stock is easily rolled into roll 62 for shipping. At an installation site, an installer need simply fit end pieces in the bottom corners of a framed-in opening and measure the proper length of the central web needed to span and overlap the end pieces. A length of central web stock is then pulled from the roll and cut easily to the proper length. Since the stock is flat, the cutting operation is simple and not prone to causing rough or jagged ends as may be the case when cutting a prior art central web. For installation of the central web, the inside flange 67 is bent up along hinge 68 and the flashing strip 64 is bent down along hinge 66. The thus cut and formed central web may then be installed in the framed-in opening in the usual way as discussed above.

FIGS. 5 and 6 illustrate alternate methods of forming the flexible hinges of the central web stock 61 according to this aspect of the invention. In FIG. 5, the central web stock is co-extruded, using know co-extrusion processes, with thin strips of flexible lower durometer material that separates the top panel 63 from the flashing strip 64 (and inside flange), thus forming the flexible hinge 66 (and 68). The central web stock is then easily bent along this hinge line to define the final shape of a central web cut from the roll 62. Alternatively, as illustrated in FIG. 6, the central web stock 61 may simply be extruded with score lines 69 that define the hinges 66 and 68. As with the embodiment of FIG. 5, a cut-off length of central web is simply bent along the score lines to form the central web, which is then installed in a traditional way.

While the central web stock 61 in FIGS. 4 through 6 is illustrated with its inside flange and flashing strip co-extensive with the top panel for rolling, it is also possible, and contemplated by this invention, that the flange and flashing strip may be folded over along their hinge lines to overlap a portion of the top panel 63. This configuration also allows for rolling of the central web stock into a roll, but provides the added advantage that the roll is thinner, which can reduce packing space and shipping costs. Either or other configurations of rollable central web stock are within the scope of the invention.

Finally, the central web stock is the preferred embodiment is formed with a flange and flashing strip made of a hard plastic that are attached to the panel 63 with flexible hinges, the invention also contemplates that the flange and or flashing strip may be formed completely of a softer flexible plastic extending laterally from the edges of the panel 63. With such a configuration, the web stock is also rollable and the flexible flange and flashing strips can be bent into the proper configuration during the installation process.

The invention has been described herein in terms of preferred embodiments and methodologies. It will be understood by those of skill in the art, however, that a wide variety of additions, deletions, and modifications may well be made to the preferred embodiments illustrated herein without departing from the spirit and scope of the invention. For instance, in the preferred embodiments, the central web is installed after the end pieces are fitted and the ends of the central web partially overlap the end pieces. Thus, it is the central web that is non-opaque in the preferred embodiments to permit visual inspection of the pool of adhesive sealant between the overlapping sections. An equivalent construction, however, could entail the installation first of a central web and then the fitting of end pieces that partially overlie the ends of the central web. In such an equivalent system, it would, of course, be the end pieces that are transparent, translucent, or otherwise non-opaque to allow visual inspection of the pool of adhesive sealant between the overlapping portions of the web and end pieces. Accordingly, the preferred embodiments presented herein are intended only as that, and as illustrating the best mode known to the inventors of carrying out the various aspects of the inventions disclosed herein. The scope of the invention embodied in the illustrated embodiments is limited only by the claims presented below.

What is claimed is:

1. A sill pan system for installation on the sill plate of a framed-in opening extending between the bottom end portions of vertical studs of the framed-in opening, said sill pan system comprising:

a first end piece configured to be fitted at one end of the sill plate adjacent the bottom end portion of one of the vertical studs;

a second end piece to be fitted at the other end of the sill plate adjacent the bottom end portion of the other one of the vertical studs;

a central web sized to span said end pieces, said central web at least partially overlapping each of said end pieces; and an adhesive sealant disposed in the regions of overlap between said end pieces and said central web;

said central web being non-opaque at least in the regions of overlap to provide visual confirmation that a seal is formed by the adhesive sealant.

2. A sill pan system as claimed in claim 1 and wherein said central web is non-opaque along its entire length.

3. A sill pan system as claimed in claim 1 and wherein central web is transparent at least in the regions of overlap.

4. A sill pan system as claimed in claim 1 and wherein said central web is translucent at least in the regions of overlap.

5. A sill pan system as claimed in claim 1 and wherein said end pieces are formed with inside flanges and wherein said central web also is formed with an inside flange that forms an extension of said inside flanges of said end pieces.

6. A sill pan system as claimed in claim 5 and further comprising a slot formed along said inside flange of said central web, said slot configured to receive and hold a section of the inside flange of each of said end pieces to hold the overlapping portions of said central web and end pieces in place.

7. A sill pan system as claimed in claim 1 and further comprising a longitudinal channel formed along said central web for channeling water toward said end pieces.

8. A sill pan system as claimed in claim 7 and wherein said longitudinal channel is formed by upstanding ribs extending along said central web.

9. A sill pan system as claimed in claim 7 and wherein said longitudinal channel is formed by at least one longitudinal deformation extending along said central web.

10. A sill pan system as claimed in claim 9 and wherein said at least one longitudinal deformation includes an upturned bulge.

11. A sill pan system as claimed in claim 9 and wherein said at least one longitudinal deformation includes a trough.

12. In a sill pan system wherein a central web extends between and at least partially overlaps spaced apart end pieces and is sealed within the regions of overlap with a sealant, the improvement wherein said central web is non-opaque at least in the regions of overlap to permit visual confirmation that a good seal is formed by the sealant.

13. The improvement of claim 12 and wherein said central web is transparent at least in the regions of overlap.

14. The improvement of claim 12 and wherein said central web is translucent at least in the regions of overlap.

15. In a sill pan system wherein a central web extends between and at least partially overlaps spaced apart end pieces and is sealed within the regions of overlap with a sealant, the improvement comprising means for mechanically holding the overlapping portions of the central web and end pieces together as the sealant cures, and wherein the end pieces have an upstanding inside flange and the central web has an upstanding inside flange, said means for mechanically holding comprises a slot formed along said inside flange of said central web, said slot receiving and holding said inside flanges of said end pieces in the regions of overlap.

16. A method of installing a sill pan along the sill plate of a framed-in opening, said sill pan having a central web spanning and at least partially overlapping spaced apart end pieces, said sill pan being non-opaque at least in the regions of overlap, said method comprising the steps of:

(a) fitting the end pieces at opposed ends of the sill plate;

(b) applying an adhesive sealant in the regions where the central web will overlap the end pieces;

(c) moving the central web in place with its ends overlapping the end pieces;

(d) pressing the overlapping ends of the central web into the adhesive sealant; and (e) visually observing the pool of adhesive sealant through the non-opaque central web to confirm that a complete seal has been formed by the adhesive sealant.

17. In a sill pan system wherein end pieces and the ends of a central web overlap and are adhered and sealed together with adhesive sealant to form a sill pan, the improvement wherein the adhesive sealant is visible in the regions of overlap to confirm the integrity of the seal, and wherein the ends of the central web at least partially overlap the end pieces and the central web is non-opaque in to regions of overlap so that the adhesive sealant is visible through the central web.

18. The improvement of claim 17 and wherein the central web is transparent in the regions of overlap.

19. The improvement of claim 17 and wherein the central web is translucent in the regions of overlap.

20. In a sill pan system wherein end pieces and the ends of a central web overlap and are adhered and sealed together with adhesive sealant to form a sill pan, the improvement wherein the adhesive sealant is visible in the regions of overlap to confirm the integrity of the seal, and wherein the end pieces at least partially overlap the ends of the central web and the end pieces are non-opaque in the regions of overlap so that the adhesive sealant is visible through the end pieces.

21. The improvement of claim 20 and wherein the end pieces are transparent.

22. The improvement of claim 20 and wherein the end pieces are translucent.

* * * * *